US005188258A

United States Patent [19]

Iwashita

[11] Patent Number: 5,188,258

[45] Date of Patent: Feb. 23, 1993

[54] APPARATUS REPONSIVE TO PRESSURE OF A MEDIUM WHICH EFFECTS FLUID DISCHARGE FOR CONTROLLING THE PRESSURE OF THE MEDIUM AND THE TIME THE MEDIUM ACTS ON THE FLUID

[75] Inventor: Isao Iwashita, Tokyo, Japan

[73] Assignee: Iwashita Engineering, Ltd., Tokyo, Japan

[21] Appl. No.: 677,771

[22] Filed: Mar. 29, 1991

[30] Foreign Application Priority Data

Apr. 7, 1990 [JP] Japan ..... 2-92723

[51] Int. Cl.[5] ..... B65D 83/14

[52] U.S. Cl. ..... 222/61; 156/356; 118/684

[58] Field of Search ..... 222/61, 399, 394; 118/879, 882, 684; 156/64, 356

[56] References Cited

U.S. PATENT DOCUMENTS

| | | | |
|---|---|---|---|
| 3,347,418 | 10/1967 | Fefferman | 222/61 |
| 3,666,143 | 5/1972 | Weston | 222/61 |
| 3,804,299 | 4/1974 | Kain | 222/61 |
| 4,874,444 | 10/1989 | Satou et al. | 222/61 X |

FOREIGN PATENT DOCUMENTS

| | | | |
|---|---|---|---|
| 0122086 | 10/1978 | Japan | 222/61 |
| 2-199281 | 8/1990 | Japan . | |
| 1239520 | 6/1986 | U.S.S.R. | 222/61 |

OTHER PUBLICATIONS

"Electropneumatic Liquid Microdispenser" V. F. Matveer, M. B. Arturov and L. M. Meilakha, Ind. Lab. (USA), vol. 46, No. 7 (Jul. 1980) (Publ. Jan. 1981).

*Primary Examiner*—Andres Kashnikow
*Assistant Examiner*—Anthoula Pomrening
*Attorney, Agent, or Firm*—Flynn, Thiel, Boutell & Tanis

[57] ABSTRACT

A quantitative fluid discharge device includes an arrangement for pressurizing fluid within a container and discharging the fluid from the container at a predetermined rate. A dispense control apparatus is provided for controlling the rate of fluid discharge from the container. The dispense control apparatus includes a keyboard from which signals for effecting initialization and discharge may be input, and a microcomputer for receiving those signals from the keyboard. An interface receives a digital pressure command signal from the microcomputer, and an electropneumatic regulator receives an analog pressure command signal from this interface. The electropneumatic regulator includes an air channel, and a solenoid valve is disposed in a middle part of this air channel. A pressure sensor for detecting the discharge air pressure acting on the fluid is disposed at a location which permits detection of the discharge air pressure while the fluid is being discharged from the container.

11 Claims, 7 Drawing Sheets

APPARATUS REPONSIVE TO PRESSURE OF A MEDIUM WHICH EFFECTS FLUID DISCHARGE FOR CONTROLLING THE PRESSURE OF THE MEDIUM AND THE TIME THE MEDIUM ACTS ON THE FLUID

FIELD OF THE INVENTION

This invention relates to an apparatus for stably controlling a pressure change type fluid discharge rate of a quantitative discharge device, and particularly to such an apparatus having a pressure sensor for permitting discharging of fluid from the discharge device at a predetermined rate.

BACKGROUND OF THE INVENTION

A quantitative discharge device for discharging fluid from a discharge side of a container at a predetermined rate while pressurizing the fluid in the container is applicable to fluids of a wide range of viscosities from water (a low viscous fluid) to a paste-like highly viscous fluid. The device can discharge a desired quantity of fluid from a very small quantity to a very large quantity. For that reason, the range of application of the device is very wide, and the device can properly cope with various working processes such as drip and sealing, coating, filling, etc. and is used in the manufacture of electronics, container filling and many other fields of industry.

In the conventional quantitative discharge device, the rate of fluid discharge is controlled using a certain discharge time and a certain discharge air pressure, and the quantity of fluid within the container is decreased with the progress of discharge work while the volume of compressed air in the container is correspondingly increased. The discharge air pressure is gradually reduced in inverse proportion to the increase in volume of such compressed air and discharge accuracy of the quantitative discharge device deteriorates. As a result, the quantitative discharge is not performed satisfactorily.

In order to avoid this inconvenience, the present applicant has already developed a device for automatically controlling and changing the air pressure applied to the fluid and/or the discharge time of the fluid, thereby to realize the desired quantitative discharge.

However, it does not disclose the mounting position of the pressure sensor for detecting air pressure at the time when the fluid is discharged, and discharge characteristics of an apparatus for controlling pressure change type discharge rate stabilization dispense, which are available depending on the mounting position of the pressure sensor, cannot be achieved.

Therefore, in an attempt to obviate the above-mentioned inconvenience and improve upon the present applicant's aforementioned device, the present invention provides a dispense control apparatus for stably controlling a pressure change type fluid discharge rate of a quantitative discharge device, such dispense control apparatus having a pressure sensor. The dispense control apparatus comprises a keyboard for inputting signals for effecting initialization and discharge, a microcomputer for receiving signals from the keyboard for effecting initialization and discharge, an interface for receiving a digital pressure command signal from said microcomputer, an electropneumatic regulator for receiving an analog pressure command signal from said interface, a solenoid valve disposed in a middle part of an air channel of said electropneumatic regulator, and a pressure sensor for detecting discharge air pressure of acting on the fluid, said pressure sensor being disposed so as to be able to detect discharge air pressure at the time when the fluid is discharged from said quantitative discharge device, whereby discharge characteristics of said apparatus are disclosed. The mounting position of said pressure sensor can be established depending on the fluid, and much easier handling is ensured.

With the aforementioned arrangement, discharge air pressure is detected by the pressure sensor at the time when the fluid is discharged from the quantitative discharge device. Then a calculation is made by the dispense control apparatus in accordance with pressure and time signals produced while the fluid is being discharged, and the undesirable reduction of the fluid discharge rate caused by reduction of fluid quantity during fluid discharge is automatically avoided by controlling and stabilizing the discharge rate of the fluid, thereby achieving the desired quantitative discharge.

BRIEF DESCRIPTION OF THE DRAWINGS

Embodiments of the present invention will be described in detail with reference to the drawings, in which.

DETAILED DESCRIPTION

Figure 1:
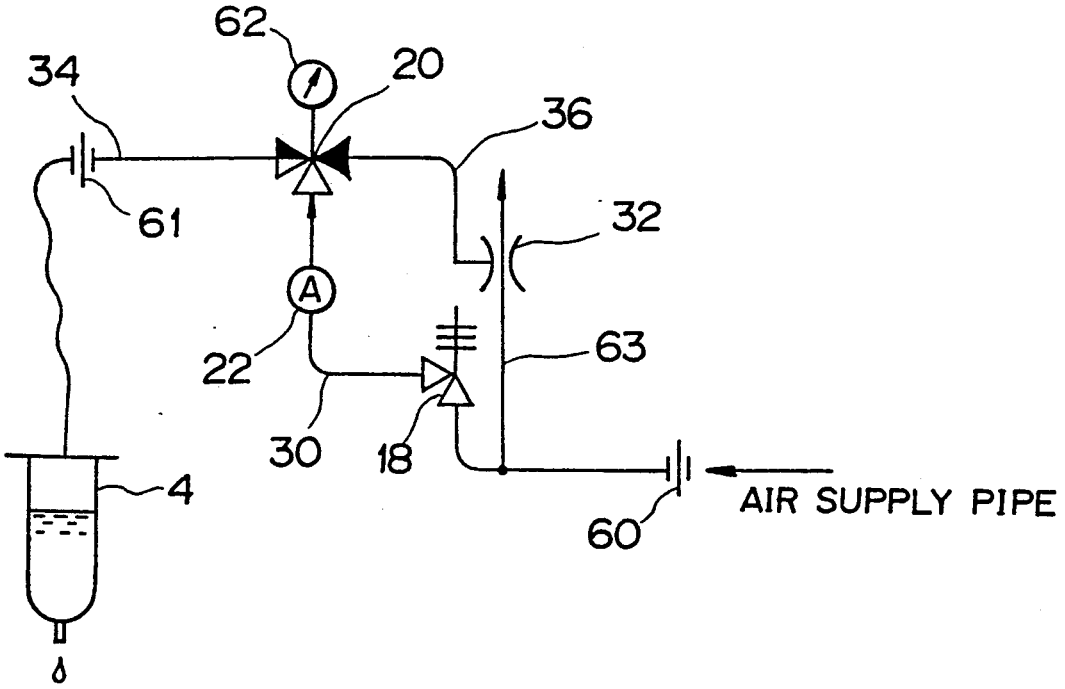
FIG. 1 is a schematic view showing a mounting position of a pressure sensor in the present invention.
Figure 2:
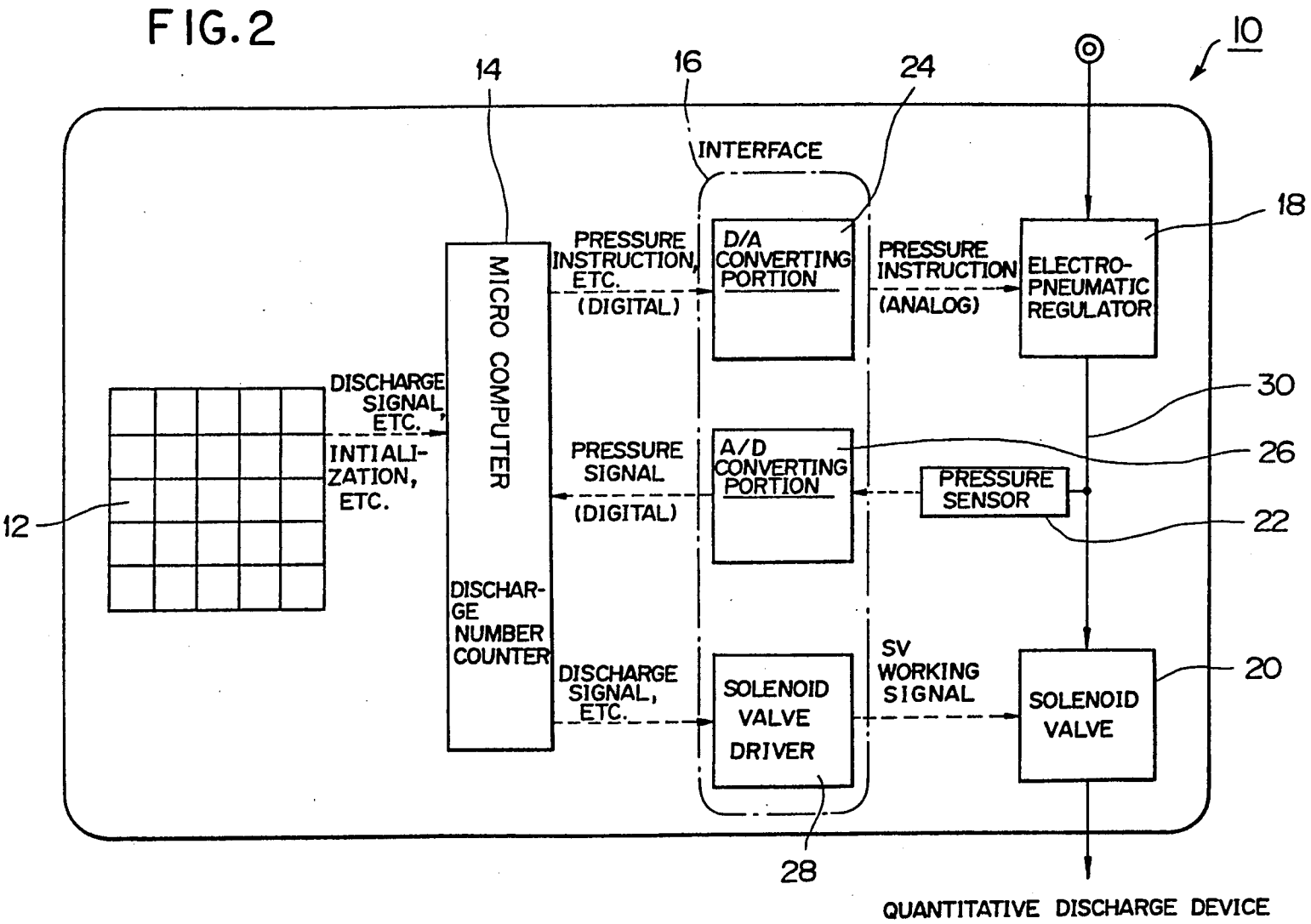
FIG. 2 is a schematic block diagram of a dispense control apparatus according to the invention.
Figure 3:
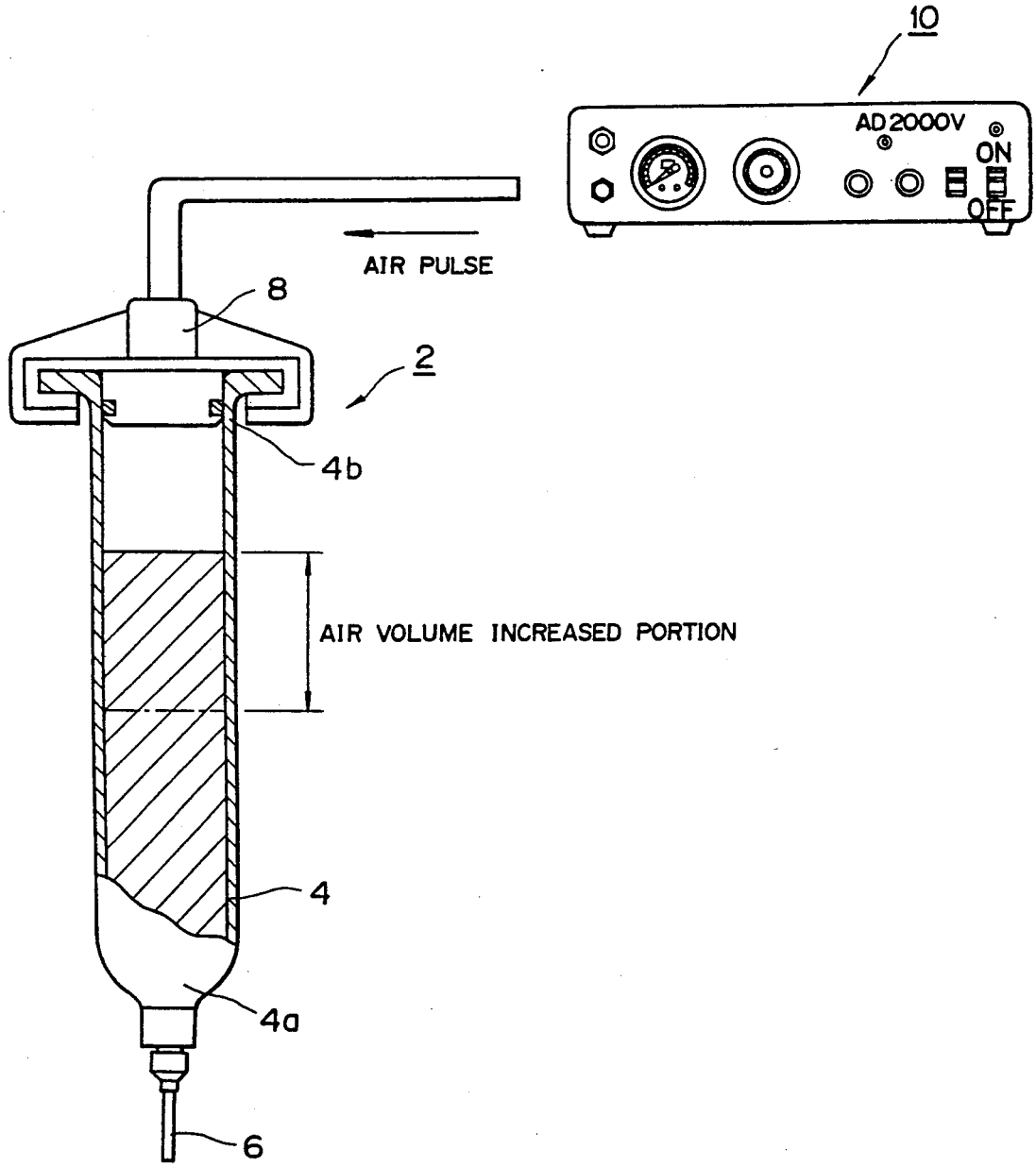
FIG. 3 is a schematic view showing the construction of and cooperation between a quantitative discharge device and the dispense control apparatus of FIG. 2.

FIGS. 1 through 3 denote a first embodiment of the present invention. In FIG. 3, the numeral 2 denotes a quantitative discharge device, 4 a container having a cylindrical shape, 6 a needle portion disposed on a discharge side 4*a* at one end of the container 4, 8 a connecting portion disposed on an inlet side 4*b* at the other end of the container 4, and 10 a pressure change type dispense control device for stabilizing pressure change.

In the quantitative discharge device 2, fluid is filled in the container 4 and the connecting portion 8 is connected to the inlet side 4*b* in order to pressurize the fluid in the container 4.

Referring to FIG. 2, the dispense control apparatus 10 comprises a keyboard 12 for inputting signals for effecting initialization and discharge, a microcomputer (i.e. a conventional microcomputer circuit) 14 for receiving from the keyboard 12 signals for effecting initialization and discharge, an interface 16 for receiving an input digital pressure command signal from the microcomputer 14, an electropneumatic regulator 18 for receiving an input analog pressure command signal from the interface 16, a solenoid valve 20 disposed in the middle of an air channel 30 (as will be described below) of the electropneumatic regulator 18, and a pressure sensor 22 for detecting discharge air pressure acting on the fluid. The pressure sensor 22 is disposed so as to be able to detect air pressure at the time when the fluid is discharged from the quantitative discharge device 2.

The interface 16 comprises a D/A converting portion 24, an A/D converting portion 26, and a solenoid valve driver 28, the D/A converting portion 24 being connected between the microcomputer 14 and the electropneumatic regulator 18.

The solenoid valve 20 is disposed in a middle part of a first air channel 30 through which compressed air from the electropneumatic pneumatic regulator 18 passes, the solenoid valve being disposed at the end of this middle part nearest the needle portion 6, and the pressure sensor 22 is disposed in a place such as, for example, position A between the electropneumatic regulator 18 and the solenoid valve 20 of FIG. 1, from where air pressure can be detected at the time when fluid is discharged from the quantitative discharge device 2.

The solenoid valve 20 is connected to the solenoid valve driver 28 which is connected to the microcomputer 14, and the pressure sensor 22 is connected to the A/D converting portion 26 which is connected to the microcomputer 14.

The dispense control apparatus 10 functions to control, automatically and in steps, changes in both or a selected one of air pressure exerted on the fluid by the electropneumatic regulator 15 and discharge time of the quantitative discharge device 2. Such control is accomplished by an increase or decrease of the opening and closing time of the first air channel 30 by the solenoid valve 20 in response to signals which represent air pressure and the time fluctuation thereof during the discharge of fluid from the quantitative discharge device 2 as shown, for example, in FIG. 4.

Referring to FIG. 1, the numeral 32 denotes an ejector (i.e., a throttle) which is in communication with the solenoid valve 20. A second air channel or gas channel 34 intercommunicates the solenoid valve 20 and the container 4, and a third air channel or gas channel 36 intercommunicates the solenoid valve 20 and the ejector 32. The first air channel 30 is a NC (normally closed) type, the second air channel 34 is a NO (normally open) type, and the third air channel 36 is a C (common) type (i.e., a conventional air passage).

A coupler 60 connects the air supply pipe to the regulator 18 and the throttle 32. Another coupler 61 connects the second air channel 34 to the container 4. An air pressure gauge 62 monitors the air pressure in passage 34.

The flow velocity of air which is supplied from coupler 60 to throttle 32 (via air passage 63) can be increased by the throttle 32 such that air within passage 36, as connected to throttle 32, is suctioned by ejector effect to produce a negative pressure.

When air pressure exerted on the fluid by the electropneumatic regulator 18 is automatically controlled, discharge air pressure is detected by the pressure sensor 22 during the discharge of fluid from the quantitative discharge device 2. This discharge air pressure and the time fluctuation thereof are input into the microcomputer 14 as reference values. The decreased quantity of fluid and the corresponding increased quantity of air volume are calculated on the basis of the reference values, and pressure on the fluid is changed by the electropneumatic regulator 18 thereby to realize the desired quantitative discharge.

Also, while fluid discharge from the quantitative discharge device 2 is being controlled through automatic increases and decreases of the opening time of the first air channel 30 by operation of the solenoid 20, the pressure signal from the pressure sensor 22 is input into the microcomputer 14 as a reference value, the decreased quantity of fluid and corresponding increased quantity of air volume are calculated with reference to the reference value, and the opening time of the third air channel 36 of the solenoid valve 20 is increased, thereby to realize the desired quantitative discharge.

The pressure sensor 22 disposed between the electropneumatic regulator 18 and the solenoid valve 20 detects air pressure which passes the electropneumatic regulator 18 and reaches the solenoid valve 20. This allows both the pressure on the fluid during discharge thereof from the quantitative discharge device 2, and the discharge time of the quantitative discharge device 2 to be automatically changed in accordance with the pressure signal, thereby to realize the desired quantitative discharge.

Also, although the pressure sensor 22 is strongly affected by the orifice created when the solenoid valve 20 is opened, the quantitative discharge is achieved in accordance with the increase of cavity volume in the container 4.

Figure 4:
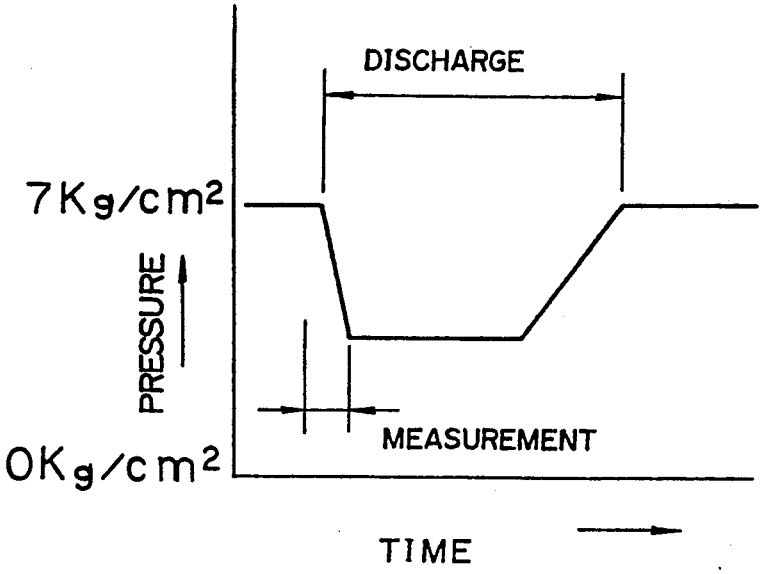
FIG. 4 is a diagram showing the time and pressure relation between a discharge state and a measurement state.

Furthermore, as shown in FIG. 4, with the pressure sensor 22 disposed in position A, the discharge rate is equalized, only positive pressure from 0 to 7 $kg/cm^2$ is measured, and the sensor 22 is used for highly viscous fluids.

FIGS. 5 through 8 show a second embodiment of the present invention. In this second embodiment, parts having the same functions as those of the first embodiment are denoted by the same reference numerals.

Figure 5:
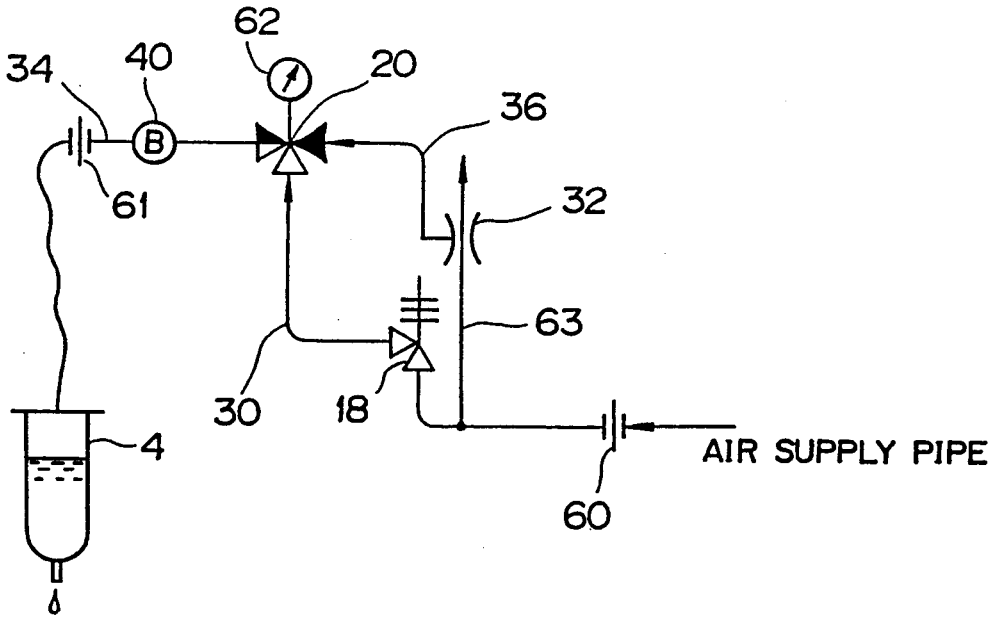
FIG. 5 is a schematic view showing a mounting position of a pressure sensor in a second embodiment of the present invention.

The feature of this second embodiment is that a pressure sensor 40 is disposed in position B as shown in FIG. 5. That is, as is shown in FIG. 5, the pressure sensor 40 is disposed in a middle part of the second air channel 34 which intercommunicates the container 4 and the solenoid valve 20.

Figure 6:
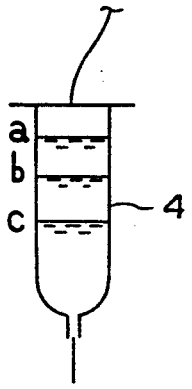
FIG. 6 is a schematic enlarged view of a fluid container of the invention.
Figure 7:
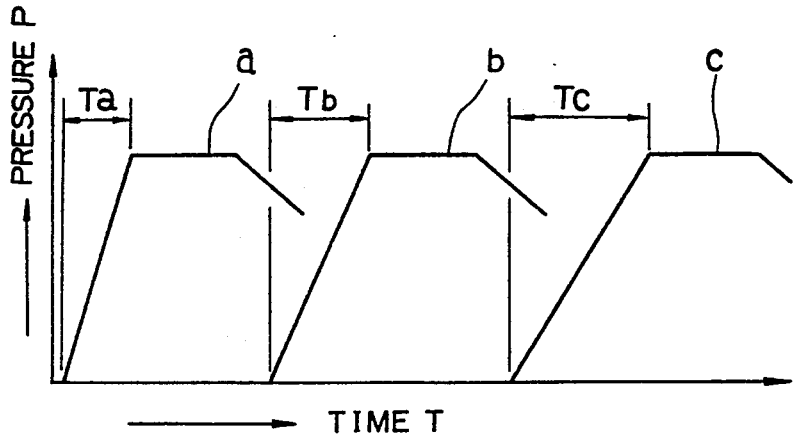
FIG. 7 is a diagram showing the relation between time and pressure in the second embodiment.

Owing to the above-mentioned positional arrangement, the pressure sensor 40 is not so directly affected by the orifice of the solenoid valve 20, and it can be recognized, as shown in FIGS. 6 and 7, that when the fluid level in the container 4 is decreased from a to c, pressure increase time is changed in accordance with the cavity capacity, thus enabling control of the quantitative discharge.

Also, Ta, Tb and Tc, as shown in FIG. 7, denote pressure increase times in accordance with the cavity capacity at respective fluid levels a, b and c. The pressure increase times Ta, Tb and Tc are functions of the cavity capacity in the container 4 and, in this example, exhibit the pressure change effect for discharge of a highly viscous fluid. That is, as is shown in FIG. 8, affection of viscosity of the fluid is hardly received by detecting pressure at the time when fluid is started to discharge.

Figure 8:
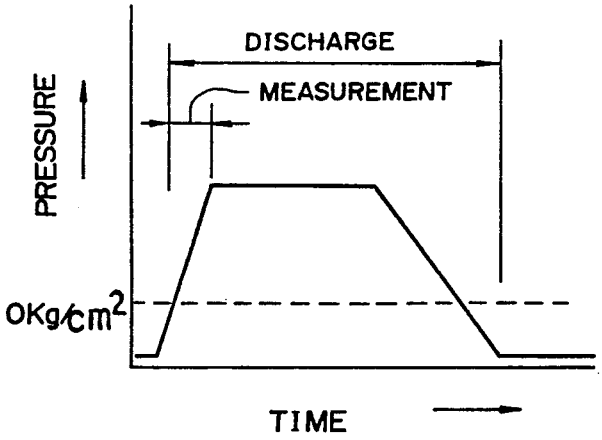
FIG. 8 is a view showing the time and pressure relation between a discharge state and a measurement state of the second embodiment.

Furthermore, as shown in FIG. 8, with the pressure sensor 40 disposed in position B, the discharge rate is equalized, and both positive and negative pressures are measured. The second embodiment having the sensor 40 is chiefly used for highly viscous fluid.

Figure 9:
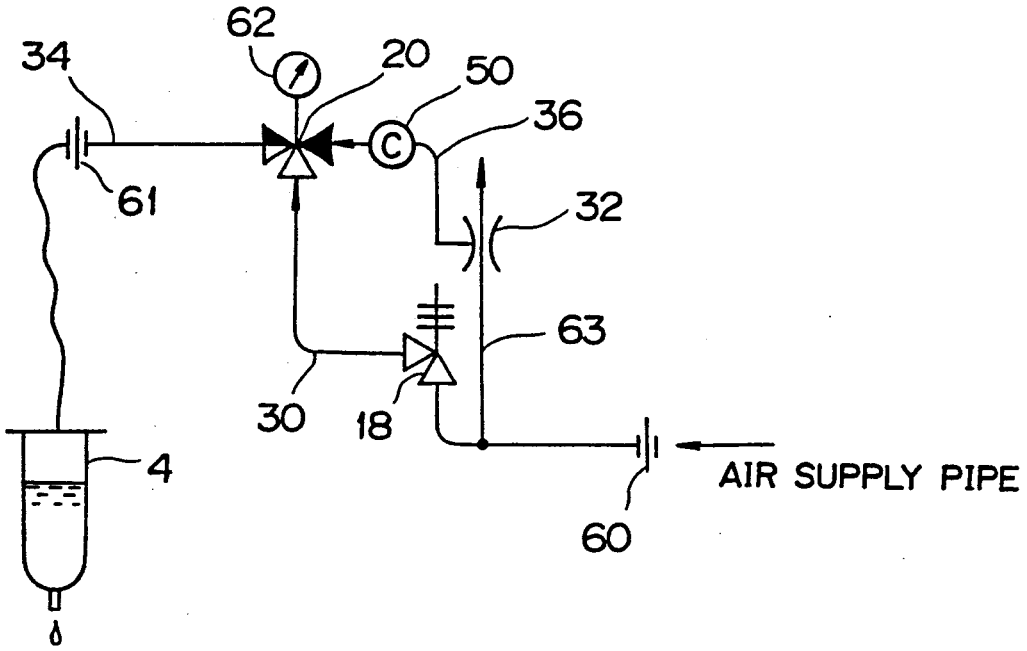
FIG. 9 is a schematic view showing a mounting position of a pressure sensor in a third embodiment of the invention.
Figure 10:
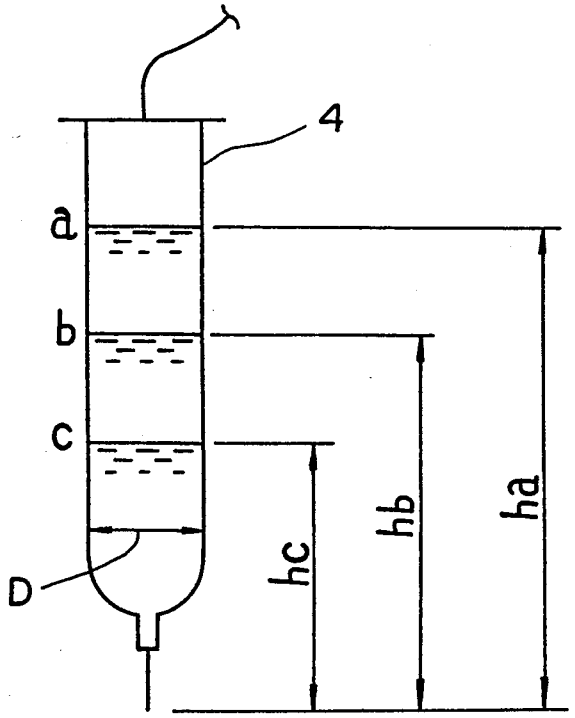
FIG. 10 is a schematic enlarged view of the fluid container of the third embodiment.
Figure 11:
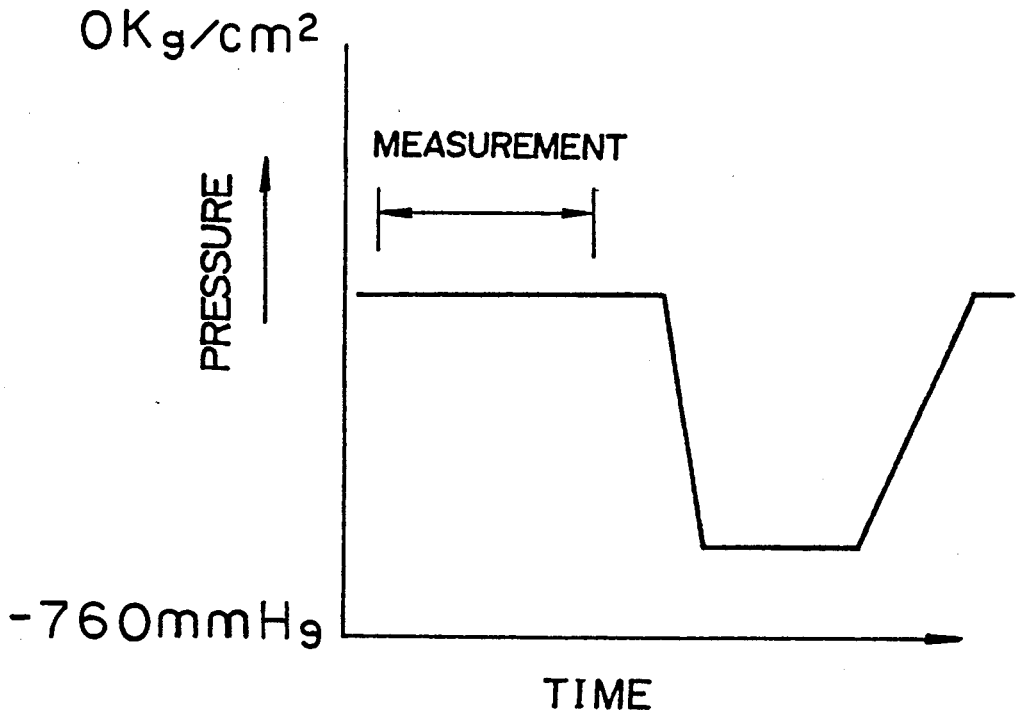
FIG. 11 is a diagram showing the time and pressure relationship between a discharge state and a measurement state of the third embodiment.

FIGS. 9 through 11 show a third embodiment of the present invention.

The feature of this third embodiment is that a pressure sensor 50 is disposed in position C as shown in FIG. 9.

That is, the pressure sensor 50 is disposed in a middle part of the third air channel 36 which intercommunicates the solenoid valve 20 and the ejector 32. Owing to the above-mentioned positional arrangement, the pressure sensor 50 does not detect the change of positive pressure with time when the fluid is discharged, but rather detects negative pressure.

In case the fluid in the container 4 is liquid, irrespective of the cavity capacity in the container 4, the surface height of the liquid is measured. Referring to FIG. 10 and presuming that: the liquid surface height in the container 4 is gradually lowered as indicated by ha (height in the position a), hb (height in the position b) and hc (height in the position c); the liquid gravity (density) is set to $\gamma$; the inner diameter of the container 4 is D; the internal pressure (when not operating) of the container 4 is $P_1$; and the discharge pressure is $P_2$; the liquid surface heights are detected as follows. If respective pressures $P_1a$, $P_1b$ and $P_1c$ are generated by a vacuum mechanism (not shown) where the respective pressures become $ha\gamma$, $hb\gamma$ and $hc\gamma$, the following relation can be obtained:

$$ha\gamma+P_1a=hb\gamma P+_1b$$

$$=hc\gamma+P_1c.$$

Therefore, the liquid surface height can be detected at the time when the pressure is changed from $P_1a$ to $P_1c$. Furthermore, because the measurement is performed at the time when the discharge apparatus is not operating to discharge fluid, a static measurement is performed irrespective of the discharge operation as shown in FIG. 11.

Similarly, in case the cavity capacity in the container 4 is measured, if the cavity capacity in the container 4 is represented by 0 (zero) for example, the air volume which flows into the container 4 becomes as follows:

$$Qa=\tfrac{1}{4}\pi D^2\cdot(ha-ha)$$

$$=0$$

$$Qb=\tfrac{1}{4}\pi D^2\cdot(ha-hb)$$

$$Qc=\tfrac{1}{4}\pi D^2\cdot(ha-hc).$$

At this time, as the velocity of air flowing into the container 4 is restricted to some extent owing to the piping conditions, the velocity of air flowing into the container 4 is changed from Va=0 to Vb and Vc.

And the velocity and the pressure can be expressed by the following relation:

$$V_1{}^2 2/g+P_1/\gamma+Z_1=V_2{}^2/2g+P_2/\gamma+Z_2$$

wherein:

$Z_1$, $Z_2$: position water head g: gravity acceleration

Accordingly, it becomes a dynamic measurement in which pressure is changed in accordance with the change in velocity.

Also, as is shown in FIG. 11, with the pressure sensor 50 disposed in position C, the discharge rate is equalized, liquid drip is prevented, only negative pressure from −760 mm Hg to 0 kg/cm$^2$ is measured, and the sensor 50 can be used for fluid of low viscosity such as water.

However, a conventional electromagnetic valve or other conventional automatic valve, etc. is required for controlling negative pressure.

Furthermore, in the third embodiment, it is understood that by detecting the liquid surface height, in case the liquid surface height is not changed even if the inner diameter of the container is changed, the liquid drip is prevented chiefly by the needle portion instead of by changing the discharge rate.

It is to be noted that the present invention is not limited to the first to third embodiments and various changes and modifications can be made.

For example, in the first to third embodiments of the present invention, the pressure sensor is disposed in a position able to detect air pressure at the time when fluid is discharged from the quantitative discharge device such as, for example, positions A, B or C of FIGS. 1, 5 or 9. However, it may be constructed such that the pressure sensor is disposed in the fluid or in other positions such that discharge air pressure is detected by the pressure sensor.

As described in detail in the foregoing, according to the present invention, discharge characteristics of the dispense control apparatus corresponding to the mounting position of the pressure sensor are disclosed, the mounting position of the pressure sensor can be established in accordance with the characteristics of the fluid to be discharged, and much easier handling is ensured.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In combination, a quantitative fluid discharge device having fluid within a container and means responsive to pressurization of the fluid in the container for discharging the fluid from a discharge side of the container at a predetermined rate, and a dispense control apparatus for controlling a pressure change type fluid discharge rate of the quantitative discharge device, said dispense control apparatus including a keyboard for inputting signals, a microcomputer for receiving said signals from said keyboard, an interface for receiving a digital pressure command signal from said microcomputer, an electropneumatic regulator for receiving an analog pressure command signal from said interface, a solenoid valve disposed in a middle part of an air channel of said electropneumatic regulator, and a pressure sensor for detecting discharge air pressure acting on the fluid, said pressure sensor being disposed at a location which permits detection of said discharge air pressure at the time when the fluid is being discharged from said quantitative discharge device, and said dispense control apparatus including means for simultaneously controlling said electropneumatic regulator and said solenoid valve so as to synchronously control both the pressure and duration of the discharge air pressure acting on the fluid being discharged.

2. A quantitative discharge device according to claim 1, wherein said air channel is an output air channel of said electropneumatic regulator, said pressure sensor being disposed in communication with said output air channel of said electropneumatic regulator upstream of said solenoid valve.

3. A quantitative discharge device according to claim 1, wherein said solenoid valve communicates with said container through a further air channel, said pressure sensor being disposed in communication with said further air channel between said solenoid valve and said container.

4. A quantitative discharge device according to claim 1, including an ejector which communicates with said solenoid valve through a further air channel, said pressure sensor being disposed in communication with said further air channel between said solenoid valve and said ejector.

5. An apparatus comprising: a quantitative fluid discharge device having means defining a container for fluid, a discharge outlet communicating with said container, and a gas inlet communicating with said container; an electromagnetic regulator having an inlet coupled to a source of pressurized gas and having an outlet; and ejector having a passageway therethrough which is coupled at one end to said source of pressurized gas, and having an outlet at which said ejector generates a negative gas pressure in response to the flow of gas through said passageway; a solenoid valve having two inlets which are respectively coupled by first and second gas channels to said outlet of said electromagnetic regulator and said outlet of said ejector, said solenoid valve also having an outlet; a third gas channel coupling said outlet of said solenoid valve to said gas inlet of said quantitative fluid discharge device; pressure sensor means for sensing a gas pressure representative of the pressure acting on the fluid in said container while fluid is being discharged through said discharge outlet, and control means responsive to said pressure sensor and coupled to control inputs of said electromagnetic regulator and said solenoid valve for simultaneously controlling said electromagnetic regulator and said solenoid valve in a manner effecting synchronous control of both the pressure and duration of gas pressure supplied through said third gas channel to said quantitative fluid discharge device.

6. An apparatus according to claim 5, wherein said pressure sensor means includes a pressure sensor communicating with said first gas channel.

7. An apparatus according to claim 5, wherein said pressure sensor means includes a pressure sensor communicating with said second gas channel.

8. An apparatus according to claim 5, wherein said pressure sensor means includes a pressure sensor communicating with said third gas channel.

9. An apparatus according to claim 5, wherein said control means includes a microcomputer, a digital to analog converter coupling an output of said microcomputer to said control input of said electromagnetic regulator, an analog to digital converter coupling an output of said pressure sensor means to an input of said microcomputer, and a solenoid valve driver circuit coupling an output of said microcomputer to said control input of said solenoid valve.

10. An apparatus according to claim 9, wherein said control means includes a keyboard having outputs coupled to inputs of said microcomputer.

11. An apparatus according to claim 5, wherein said container has a substantially cylindrical shape, wherein said quantitative fluid discharge device includes a needle portion disposed on one side of said container and having therethrough a passageway which communicates with said container at one end thereof, said passageway in said needle portion being said discharge outlet, and wherein said gas inlet communicates with said container at an end thereof remote from said needle portion.

* * * * *